US007972251B2

(12) United States Patent
Peddar

(10) Patent No.: US 7,972,251 B2
(45) Date of Patent: Jul. 5, 2011

(54) EXERCISE DEVICE AND METHOD OF USE

(76) Inventor: Jeffrey Peddar, Newton, MA (US)

( * ) Notice: Subject to any disclaimer, the term of this patent is extended or adjusted under 35 U.S.C. 154(b) by 0 days.

(21) Appl. No.: 12/493,320

(22) Filed: Jun. 29, 2009

(65) Prior Publication Data

US 2010/0004105 A1 Jan. 7, 2010

Related U.S. Application Data

(60) Provisional application No. 61/077,583, filed on Jul. 2, 2008.

(51) Int. Cl.
*A63B 21/00* (2006.01)

(52) U.S. Cl. ..... 482/132; 482/140

(58) Field of Classification Search ..... 482/132, 482/66–69, 140, 121, 72–73
See application file for complete search history.

(56) References Cited

U.S. PATENT DOCUMENTS

| | | | | |
|---|---|---|---|---|
| 2,819,081 | A * | 1/1958 | Touraine | 482/45 |
| 3,752,475 | A | 8/1973 | Ott | |
| 4,111,417 | A | 9/1978 | Gardner | |
| 4,768,778 | A | 9/1988 | Thomas, Jr. | |
| 4,892,305 | A * | 1/1990 | Lynch | 482/132 |
| 5,358,463 | A | 10/1994 | Fuentes | |
| 5,762,593 | A * | 6/1998 | Whiteley | 482/134 |
| 5,928,113 | A * | 7/1999 | Roberts | 482/57 |
| 6,017,296 | A | 1/2000 | Tang et al. | |
| 6,190,292 | B1 | 2/2001 | Panes | |
| 6,551,224 | B1 * | 4/2003 | Lim | 482/142 |
| 6,582,347 | B2 | 6/2003 | Smith | |
| 6,761,672 | B1 * | 7/2004 | Williams | 482/132 |
| 6,773,379 | B1 * | 8/2004 | Bing | 482/132 |
| 6,942,605 | B1 * | 9/2005 | Sukhovitsky | 482/132 |
| 7,144,352 | B2 * | 12/2006 | Hazan | 482/141 |
| 7,156,791 | B2 | 1/2007 | Edwards | |
| 7,172,539 | B1 * | 2/2007 | Bythewood et al. | 482/140 |
| 7,270,628 | B2 | 9/2007 | Campanaro et al. | |
| 7,357,759 | B2 * | 4/2008 | Bonnell | 482/72 |
| 2004/0002411 | A1 * | 1/2004 | Jackson | 482/121 |
| 2004/0077468 | A1 * | 4/2004 | Myles et al. | 482/140 |
| 2006/0014615 | A1 | 1/2006 | Godbold | |
| 2006/0035771 | A1 | 2/2006 | Gant | |
| 2006/0040809 | A1 | 2/2006 | Godbold | |
| 2006/0052220 | A1 * | 3/2006 | Jackson et al. | 482/52 |
| 2007/0167301 | A1 | 7/2007 | Evans | |
| 2007/0197351 | A1 * | 8/2007 | Gonzalez | 482/83 |
| 2007/0197358 | A1 * | 8/2007 | Uguralp | 482/132 |
| 2007/0238587 | A1 * | 10/2007 | Darben | 482/68 |

* cited by examiner

*Primary Examiner* — Fenn C Mathew
(74) *Attorney, Agent, or Firm* — Advantia Law Group; Michael W. Starkweather

(57) ABSTRACT

There is an exercising device, and a method of use, configured to perform upper body and abdominal type exercise. The exercise device includes a pad member configured to support a forearm of a user. The exercise device also includes a handle extending from a top surface of the pad member about a front end of the pad member and configured to provide a grip for a hand. In addition, the exercise device includes a selectably coupleable attachment member coupled to a bottom surface of the pad member and configured to alter a movement characteristic of the device when in operation. The selectably coupleable attachment member includes a plurality of wheels. The exercise device further includes a tongue and groove attachment member configured to selectably couple the attachment member to the pad member.

6 Claims, 8 Drawing Sheets

EXERCISE DEVICE AND METHOD OF USE

CROSS-REFERENCE TO RELATED APPLICATIONS

This invention claims priority, under 35 U.S.C. §120, to the U.S. Provisional Patent Application No. 61/077,583 to Jeff Peddar, filed on Jul. 2, 2008, which is incorporated by reference herein.

BACKGROUND OF THE INVENTION

1. Field of the Invention

The present invention relates to exercise devices and methods of use, specifically an exercising device configured to perform upper body and abdominal type exercise and a method of use.

2. Description of the Related Art

A physical exercise is a bodily activity that develops and maintains physical fitness and overall health. It is often practiced to strengthen muscles and the cardiovascular system, and to hone athletic skills. Frequent and regular physical exercise boosts the immune system, and helps prevent diseases of affluence such as heart disease, cardiovascular disease, Type 2 diabetes and obesity. It also improves mental health and helps prevent depression. Exercises are generally grouped into three types depending on the overall effect they have on the human body:

Flexibility exercises such as stretching improve the range of motion of muscles and joints. Aerobic exercises such as cycling, walking, running, hiking or playing tennis focus on increasing cardiovascular endurance. Anaerobic exercises such as weight training, functional training or sprinting increase short-term muscle strength. Physical exercise is important for maintaining physical fitness and can contribute positively to maintaining healthy weight, building and maintaining healthy bone density, muscle strength, and joint mobility, promoting physiological well-being, reducing surgical risks, and strengthening the immune system.

Frequent and regular aerobic exercise has been shown to help prevent or treat serious and life-threatening chronic conditions such as high blood pressure, obesity, heart disease, Type 2 diabetes, insomnia, and depression. Strength training appears to have continuous energy-burning effects that persist for about 24 hours after the training, though they do not offer the same cardiovascular benefits as aerobic exercises do. Exercise can also increase energy and raise one's threshold for pain.

There is conflicting evidence as to whether vigorous exercise (more than 70% of $VO_2$ Max) is more or less beneficial than moderate exercise (40 to 70% of $VO_2$ Max). Some studies have shown that vigorous exercise executed by healthy individuals can effectively increase opioid peptides (aka endorphins, a naturally occurring opiate that in conjunction with other neurotransmitters is responsible for exercise induced euphoria and has been shown to be addictive), positively influence hormone production (i.e., increase testosterone and growth hormone), benefits that are not as fully realized with moderate exercise.

Exercise has been shown to improve cognitive functioning via improvement of hippocampus-dependent spatial learning, and enhancement of synaptic plasticity and neurogenesis. In addition, physical activity has been shown to be neuroprotective in many neurodegenerative and neuromuscular diseases. For instance, it reduces the risk of developing dementia. Furthermore, anecdotal evidence suggests that frequent exercise may reverse alcohol-induced brain damage.

Physical activity is thought to have other beneficial effects related to cognition as it increases levels of nerve growth factors, which support the survival and growth of a number of neuronal cells. Both aerobic and anaerobic exercise also work to increase the mechanical efficiency of the heart by increasing cardiac volume (aerobic exercise), or myocardial thickness (strength training, see Organ hypertrophy). Not everyone benefits equally from exercise. There is tremendous variation in individual response to training: where most people will see a moderate increase in endurance from aerobic exercise, some individuals will as much as double their oxygen uptake, while others will never get any benefit at all from the exercise. Similarly, only a minority of people will show significant muscle growth after prolonged weight training, while a larger fraction experience improvements in strength. This genetic variation in improvement from training is one of the key physiological differences between elite athletes and the larger population. Studies have shown that exercising in middle age leads to better physical ability later in life.

Exercise equipment is any object used in exercise. This can include balls, treadmills, weights, light benches, bicycles, track shoes, jungle gyms, hydraulic equipment or protective equipment such as a back brace. However, current exercise equipment does not provide a simple and convenient abdominal workout that can easily be performed in a small area and/or be performed without excessive equipment. In particular, an arm pad device and method of exercising that efficiently and conveniently exercise abdominal muscles. Some improvements have been made in the field. Examples of references related to the present invention are described below, and the supported teachings of each reference are incorporated by reference herein:

U.S. Pat. No. 7,156,791, issued to Edwards, discloses Yoga grip blocks having one or more block sections and a grip section that provide support and comfort in the practice of yoga exercises. The invention includes preferred materials to fabricate yoga grip blocks and describes methods of using yoga grip blocks.

U.S. Pat. No. 6,582,347, issued to Smith, discloses a device for exercising abdominal muscles comprising a platform having an upper surface and a lower surface adapted for omnidirectional motion, a pair of generally longitudinal limb supporting areas positioned on said upper surface, a pair of lateral hand grips each of said pair extending from the upper surface of the platform and disposed in opposed relation laterally and outwardly from one of said limb supporting areas, and a front hand grip extending from the upper surface of the platform and disposed generally forward of the limb supporting areas. Methods for using this device are also disclosed.

U.S. Pat. No. 4,768,778, issued to Thomas, Jr., discloses an exercising device for doing a variation of a push-up exercise. The exercising device includes a base, a platform rotatably connected to the base having a plane of rotation, a support extending upwardly from the rotating platform, approximately perpendicular to the plane of rotation, and a handle removably connected to the support, the handle capable of rotation, independent of the support and the platform. And novel exercises using the above device.

U.S. Patent Application Publication No.: 2006/0014615, by Godbold, discloses a rotatable hand supports for performing pushups on a floor or ground surface. The handle of the supports has a grip portion adapted to be grasped by a user. The rotatable base is base has a bottom portion adapted to contact the floor, a top portion rotatably connected to the bottom portion, and a bearing assembly supporting the top portion on said bottom portion. A support connects the handle to the top portion of the base and supports the handle at an elevated position relative to the base and above the floor.

U.S. Patent Application Publication No.: 2006/0040809, by Godbold, discloses a rotatable hand supports for performing advanced pushups on a floor or ground surface. The main handle of the supports has a grip portion constructed to be grasped by a user. The base has a bottom portion adapted to contact the floor, a top portion rotatably connected to the bottom portion, and a bearing assembly supporting the top portion on said bottom portion. A support connects the handle to the top portion of the base and supports the handle at an elevated position relative to the base and above the floor. A hand clutch extends from the main handle and can be squeezed to perform hand-grip exercises simultaneously with a pushup exercise.

The inventions heretofore known suffer from a number of disadvantages which include being ineffective, being inefficient, being bulky, being difficult to use, being expensive, being excessive in size, being limited in application, and being limited in adaptability.

What is needed is an exercise device and method of use that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available exercise devices and methods. Accordingly, the present invention has been developed to provide an efficient and effective exercise device configured to perform upper body and abdominal type exercises.

In one embodiment of the invention, there is an exercising device configured to perform upper body and abdominal type exercise. The exercise device may include a pad member configured to support a forearm of a user. The exercise device may include a selectably coupleable attachment member coupled to a bottom surface of the pad member and configured to alter a movement characteristic of the device when in operation. The selectably coupleable attachment member may include a plurality of wheels. In addition, the exercise device may also include a handle extending from a top surface of the pad member and configured to provide a grip for a hand of the user. The handle may also include an actuation mechanism configured to control the movement of the plurality of wheels. Furthermore, the selectably coupleable attachment member may include an inclined plane. Moreover, the selectably coupleable attachment member may include a textile surface. The exercise device may further include a tongue and groove attachment member configured to selectably couple the attachment member to the pad member. The groove member may be disposed on a surface of the pad member and the tongue member may be disposed on the attachment member configured to selectably couple to the groove member.

In another embodiment of the invention, there is a method of performing upper body and abdominal exercises using an exercising device. The method may include the step of selecting an attachment member and coupling the attachment member to a bottom portion of the exercise device thereby altering an operating characteristic of the device. Then, disposing both forearms on the top surface of a pad member of the device. The method may also include gripping a handle of the device and elevating the body and supporting the body with the feet, on the floor, and the forearms on the exercising device. The method may further include moving the exercise device about a floor. In addition, the method may include moving the exercise device in horizontal and vertical movements. The method may also include moving the exercise device in diagonal movements. Furthermore, the method may include moving the exercise device in circular and rectangular movements. Moreover, the method may include the step of interchanging the attachment member and performing various exercises to include a compete workout of the upper body and abdominal muscle groups. The method may additionally include moving the exercise device with an incline plane attachment device, thereby providing greater restriction of movement.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
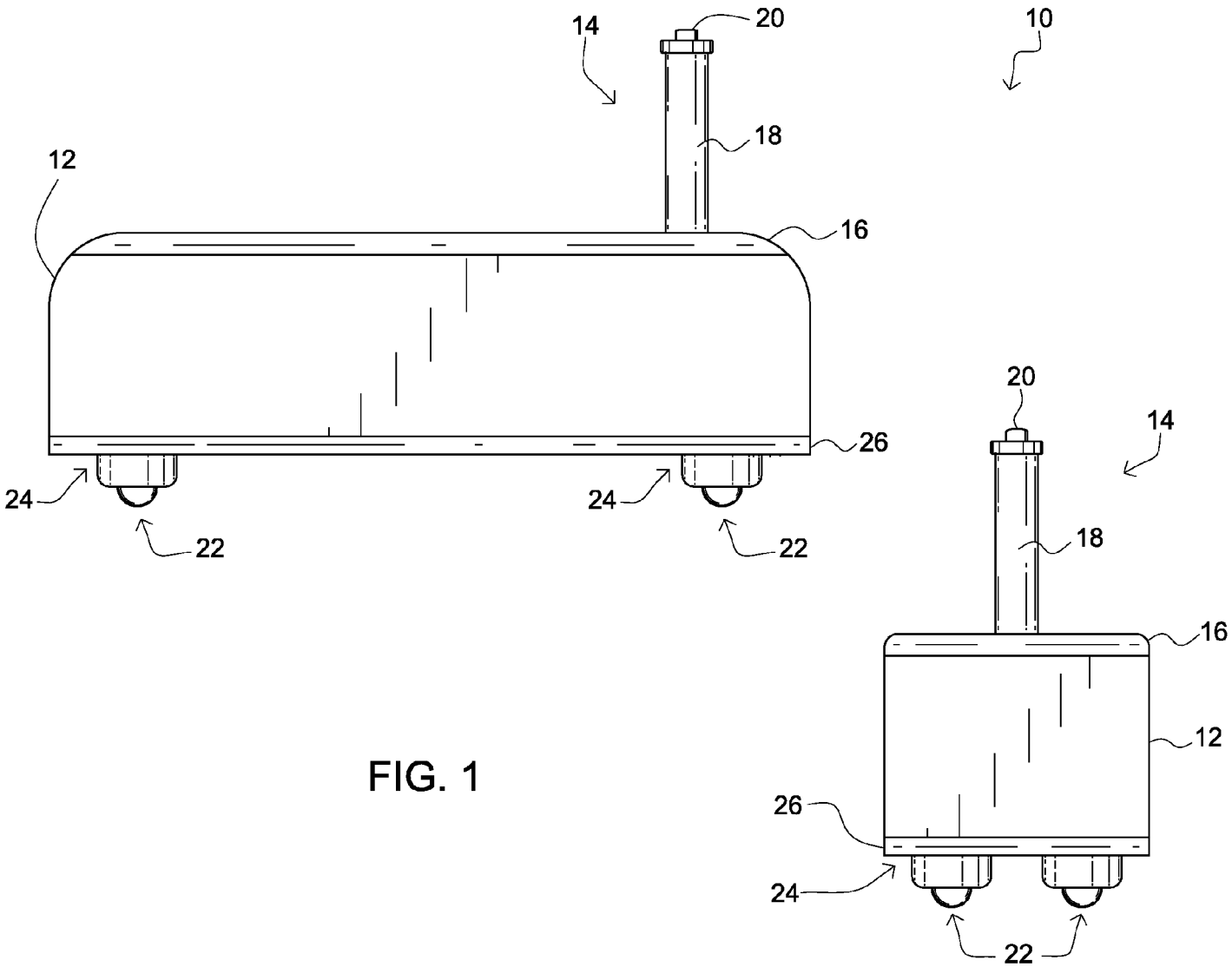
FIG. 1 is a front elevational view and a side elevational view of an exercise device, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a front elevational view and a side elevational view of an exercise device, according to one embodiment of the invention. The exercise device 10 is configured to perform upper body and abdominal type exercises. The exercise device 10 includes a pad member 12 configured to support a forearm of a user. The exercise device 10 also includes a handle 14 extending from a top surface 16 of the pad member 12 and configured to provide a grip 18 for a hand of a user. The exercise device 10 also includes a selectably coupleable attachment member 24 coupled to a bottom surface 26 of the pad member 12 and configured to alter a movement characteristic of the exercise device 10, when in operation. As illustrated in FIG. 1, the selectably coupleable attachment member 24 includes a plurality of wheels 22. In addition, the handle 14 includes an actuation mechanism 20 configured to control the movement of the plurality of wheels 22. The plurality of wheels 22 is configured to provide friction-less movement of the exercise device 10.

In operation of one embodiment of the invention, a user performs upper body and abdominal exercises using an exercising device. The user selects an attachment member and couples the attachment member to a bottom portion of the exercise device thereby altering an operating characteristic of the device. The attachment member includes a plurality of wheels. The user then disposes both forearms on the top surface of a pad member of the device. The user grips a handle of the device and elevates the body, supporting the body with the forearms on the pad member, and the feet on the floor. The user then moves the exercise device about a floor in various directions. The user moves the exercise device horizontally, vertically, diagonally, in a circular motion, or a rectangular movement.

Figure 2:
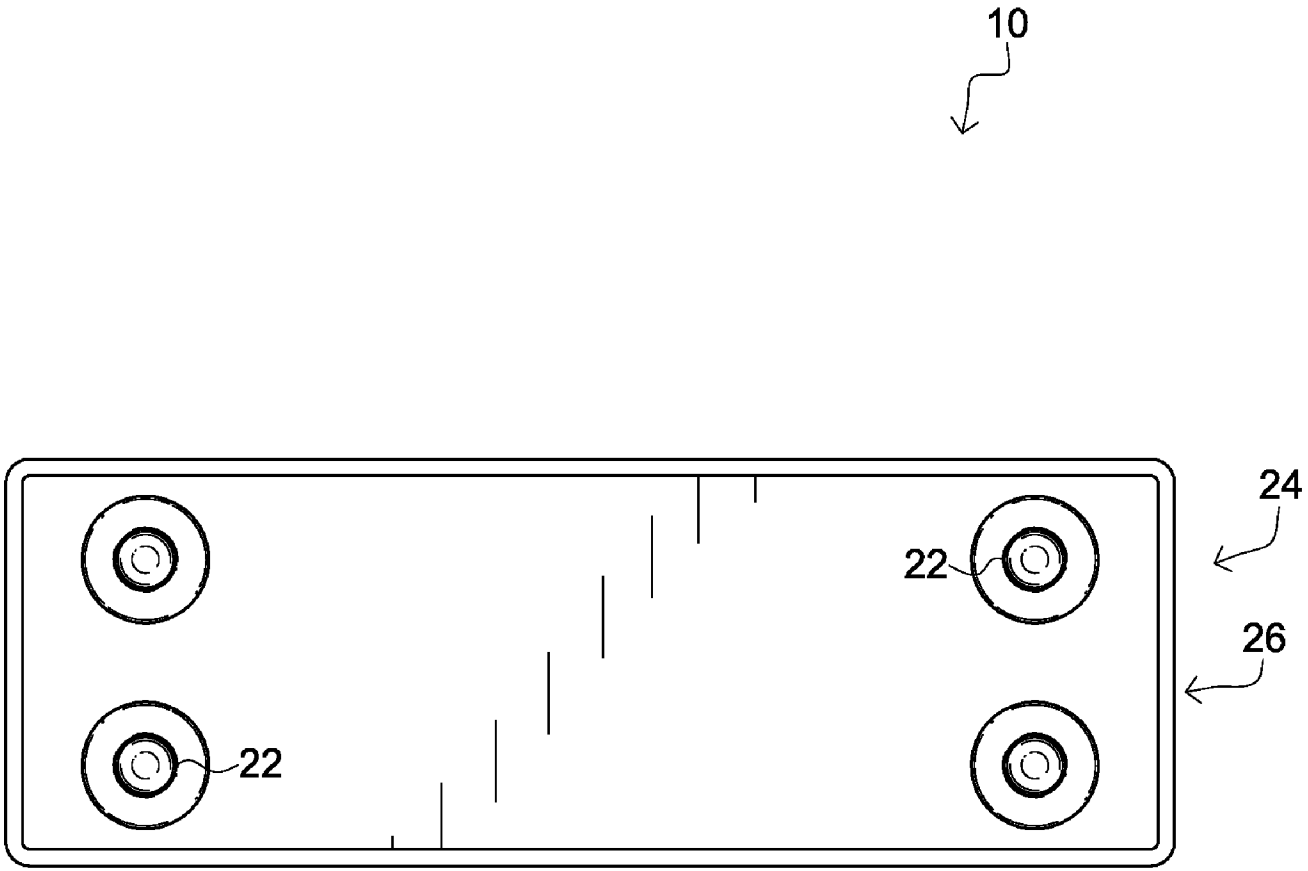
FIG. 2 is a bottom plan view of an exercise device, according to one embodiment of the invention.

FIG. 2 is a bottom plan view of an exercise device, according to one embodiment of the invention. The exercise device 10 includes a pad member configured to support a forearm of a user. The exercise device 10 also includes a selectably coupleable attachment member 24 coupled to a bottom surface 26 of the pad member and configured to alter a movement characteristic of the exercise device 10 when in operation. As illustrated in FIG. 2, the selectably coupleable attachment member 24 includes a plurality of wheels 22. The plurality of wheels 22 is configured to provide friction-less movement of the exercise device 10.

In operation of one embodiment of the invention, a user performs upper body and abdominal exercises using an exercising device. The user selects an attachment member and couples the attachment member to a bottom portion of the exercise device thereby altering an operating characteristic of the device. The user then disposes both forearms on the top surface of a pad member of the device. The user grips a handle of the device and elevates the body, supporting the body with the forearms on the pad members and the feet on the floor. The user then moves the exercise device about a floor in various directions. The user moves the exercise device horizontally, vertically, diagonally, in a circular motion, or a rectangular movement.

Figure 3:
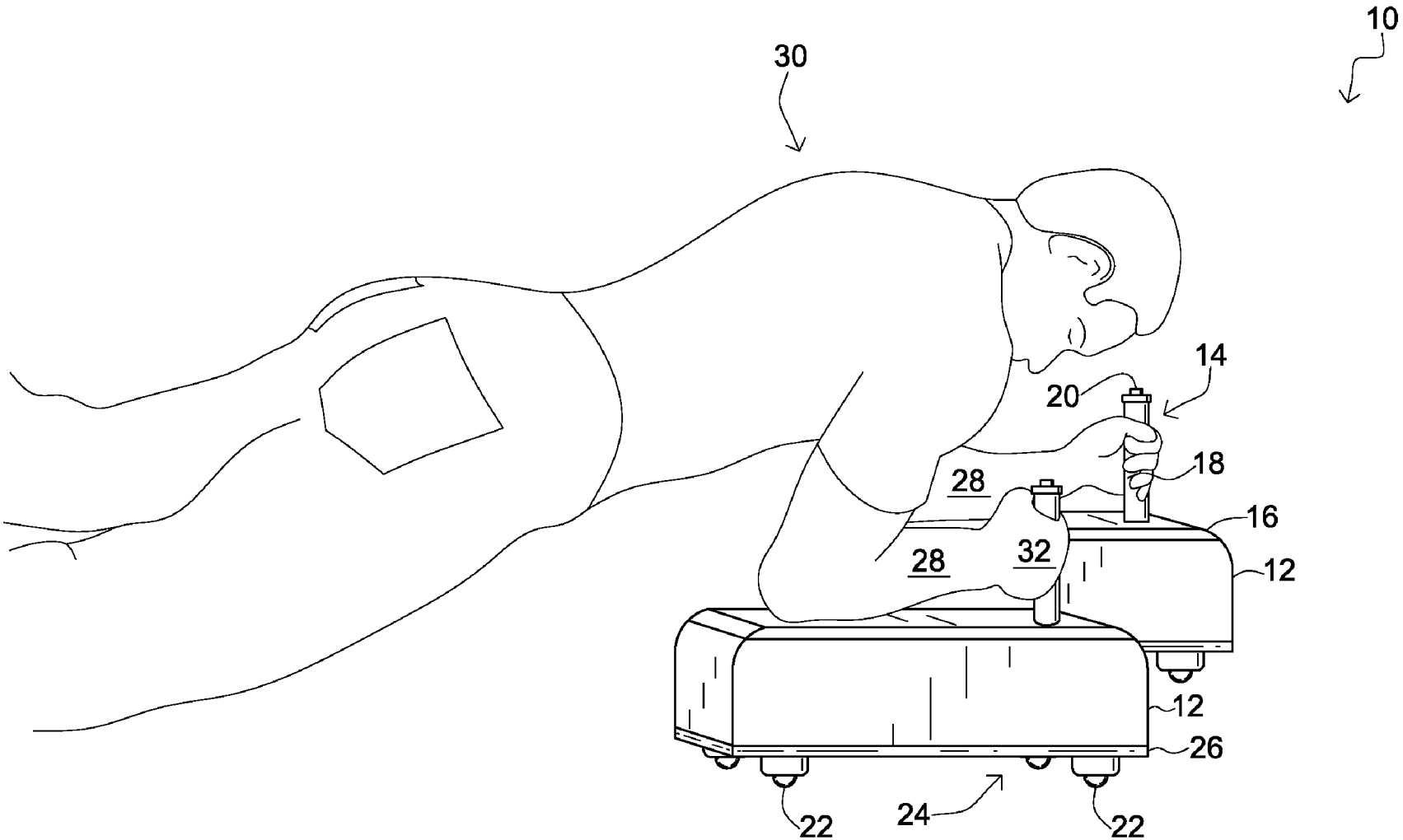
FIG. 3 is a perspective view of an exercise device in use, according to one embodiment of the invention.

FIG. 3 is a perspective view of an exercise device in use, according to one embodiment of the invention. The exercise device 10 is configured to perform upper body and abdominal type exercise. The exercise device 10 includes a pad member 12 configured to support a forearm 28 of a user 30. The exercise device 10 also includes a handle 14 extending from a top surface 16 of the pad member 12 and configured to provide a grip 18 for a hand 32 of the user 30. The exercise device 10 also includes a selectably coupleable attachment member 24 coupled to a bottom surface 26 of the pad member 12 and configured to alter a movement characteristic of the exercise device 10 when in operation. As illustrated in FIG. 3, the selectably coupleable attachment member 24 includes a plurality of wheels 22. In addition, the handle 14 includes an actuation mechanism 20 configured to control the movement of the plurality of wheels 22.

In operation of one embodiment of the invention, a user performs upper body and abdominal exercises using an exercising device. The user selects an attachment member and couples the attachment member to a bottom portion of the exercise device thereby altering an operating characteristic of the device. The user then disposes both forearms on the top surface of a pad member of the device. The user grips a handle of the device and elevates the body, supporting the body with the forearms on the pad member and the feet on the floor. The user then moves the exercise device about a floor in various directions. The user moves the exercise device horizontally, vertically, diagonally, in a circular motion, or a rectangular movement.

Figure 4:
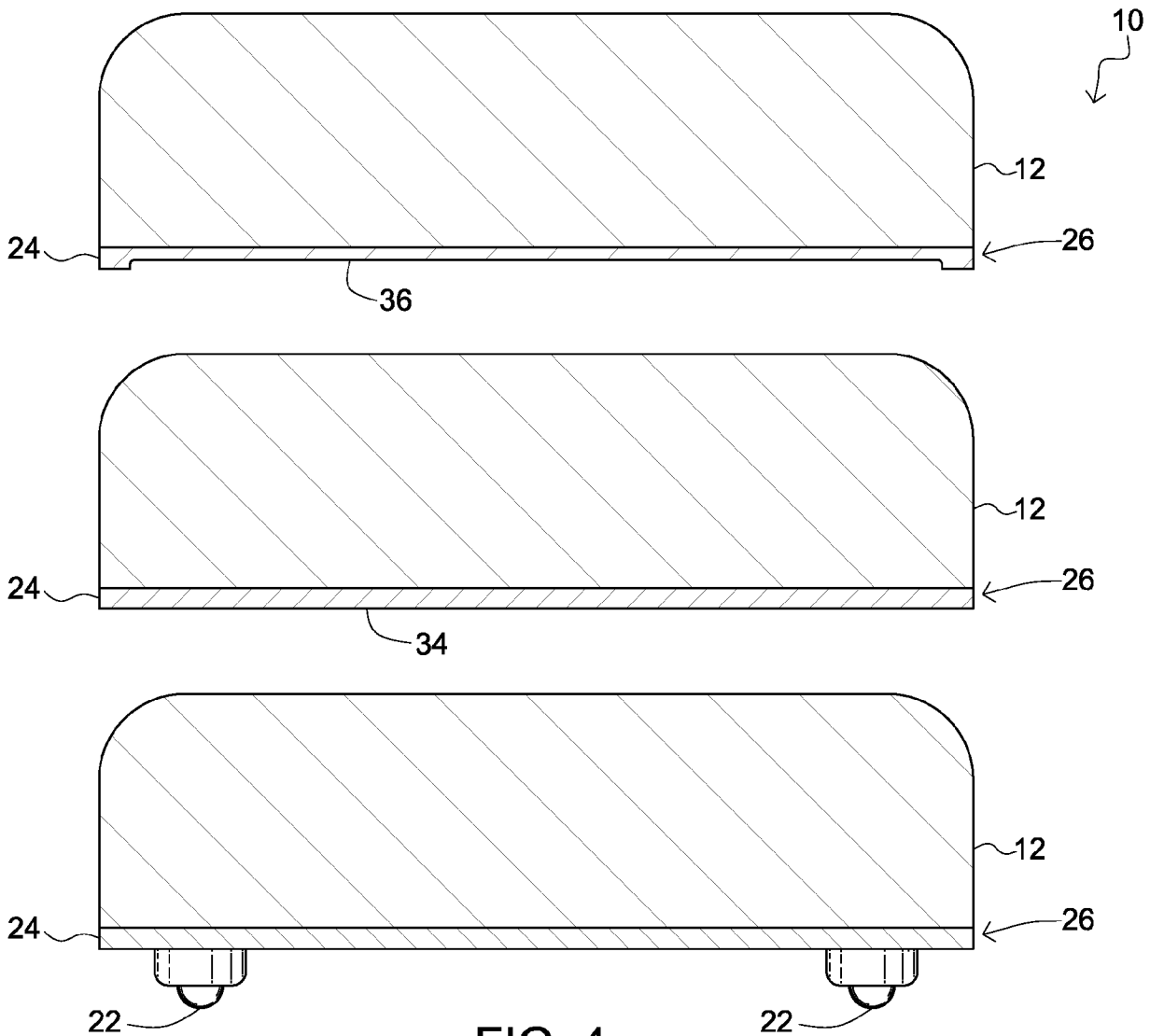
FIG. 4 is a set of side elevational views of an exercise device, according to one embodiment of the invention.

FIG. 4 is a set of side elevational views of an exercise device 10, according to one embodiment of the invention. The exercise device 10 includes a pad member 12 configured to support a forearm of a user. The exercise device 10 also includes a selectably coupleable attachment member 24 coupled to a bottom surface 26 of the pad member 12 and configured to alter a movement characteristic of the exercise device 10 when in operation. As illustrated in FIG. 4 the selectably coupleable attachment member 24 includes a plurality of wheels 22, a textile member 34, and a grooved surface 36 configured to provide various levels of difficulty, in addition to providing various exercises for different types of muscles groups.

In operation of one embodiment of the invention, a user performs upper body and abdominal exercises using an exercising device. The user selects an attachment member and couples the attachment member to a bottom portion of the exercise device thereby altering an operating characteristic of the device. The attachment member may include a grooved surface, a textile member, and a plurality of wheels. The user then disposes both forearms on the top surface of a pad member of the device. The user grips a handle of the device and elevates the body, supporting the body with the forearms on the pad members and the feet on the floor. The user then moves the exercise device about a floor in various directions. The user moves the exercise device horizontally, vertically, diagonally, in a circular motion, or a rectangular movement. Moreover, the user may interchange the attachment member to exercise various upper body muscle groups. The plurality of wheels is configured to operate on a smooth floor, the grooved surface is configured to operate on a carpeted surface, and the textile member is configured to operate on a floor. The grooved surface is configured to provide friction when the exercise device is moved in a particular direction on the carpeted surface. The textile member is configured to provide friction when the exercise device is moved in a particular direction on the floor.

Figure 5:
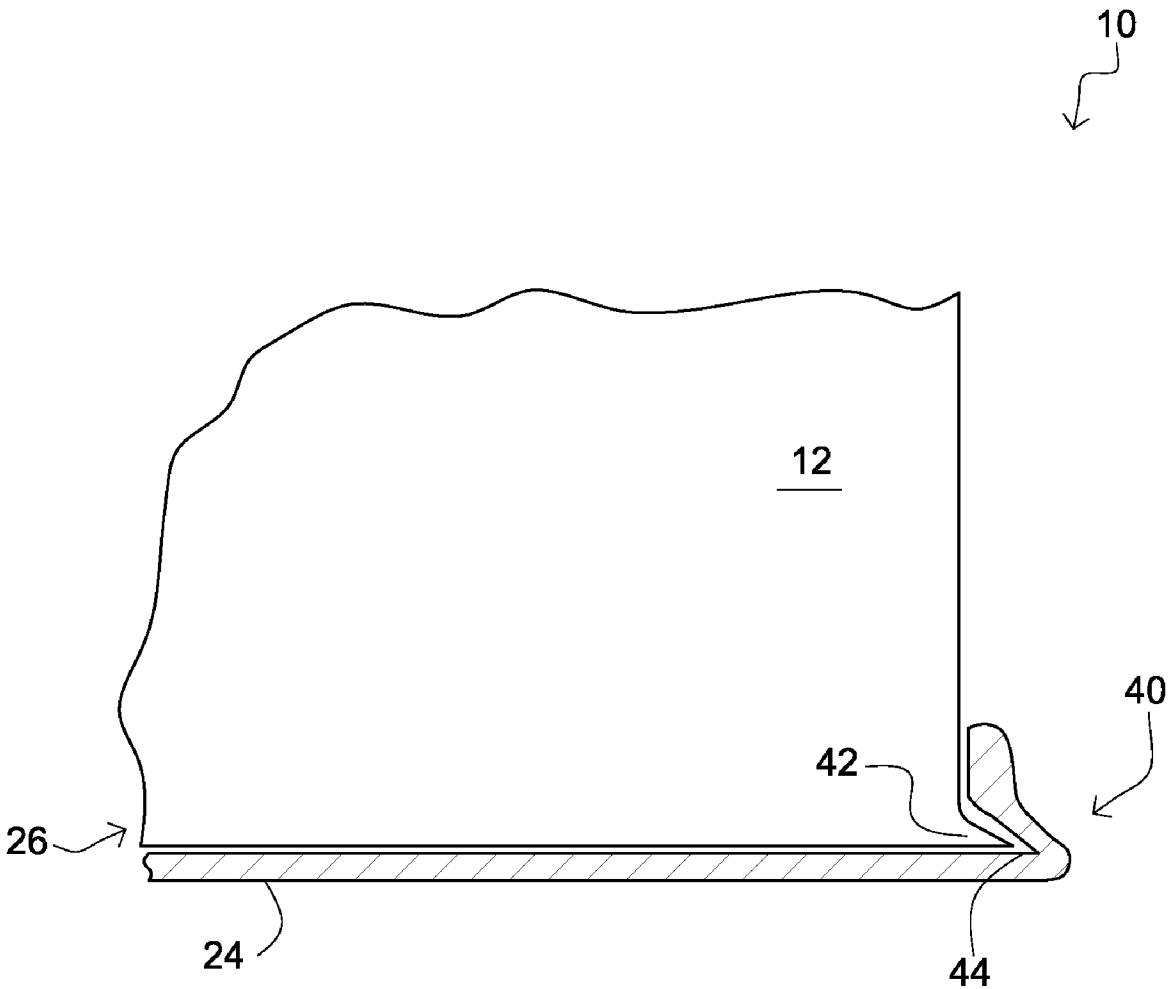
FIG. 5 is a side cross-sectional view of a tongue and groove member of an exercise device, according to one embodiment of the invention.

FIG. 5 is a side cross-sectional view of a tongue and groove member 40 of an exercise device 10, according to one embodiment of the invention. The exercise device 10 includes a pad member 12 configured to support a forearm of a user. The exercise device 10 also includes a selectably coupleable attachment member 24 coupled to a bottom surface 26 of the pad member 12 and configured to alter a movement characteristic of the exercise device 10 when in operation. As illustrated in FIG. 5, the exercise device 10 further includes a tongue and groove attachment member 40 configured to selectably couple the attachment member 24 to the pad member 12. The tongue member 42 is disposed on a surface of the pad member 12 and the groove member 44 is disposed on the attachment member 24 configured to selectably couple to the tongue member 42.

In operation of one embodiment of the invention, a user performs upper body and abdominal exercises using an exercising device. The user selects an attachment member and couples the attachment member to a bottom portion of the exercise device thereby altering an operating characteristic of the device. The user slides the groove member of the attachment member over the tongue member of the pad member, thereby securing the attachment member to the pad member. The user then moves the exercise device about a floor in various directions. The user moves the exercise device horizontally, vertically, diagonally, in a circular motion, or a rectangular movement. Moreover, the user may interchange the various types of attachment members, to exercise various upper body muscle groups.

Figure 6:
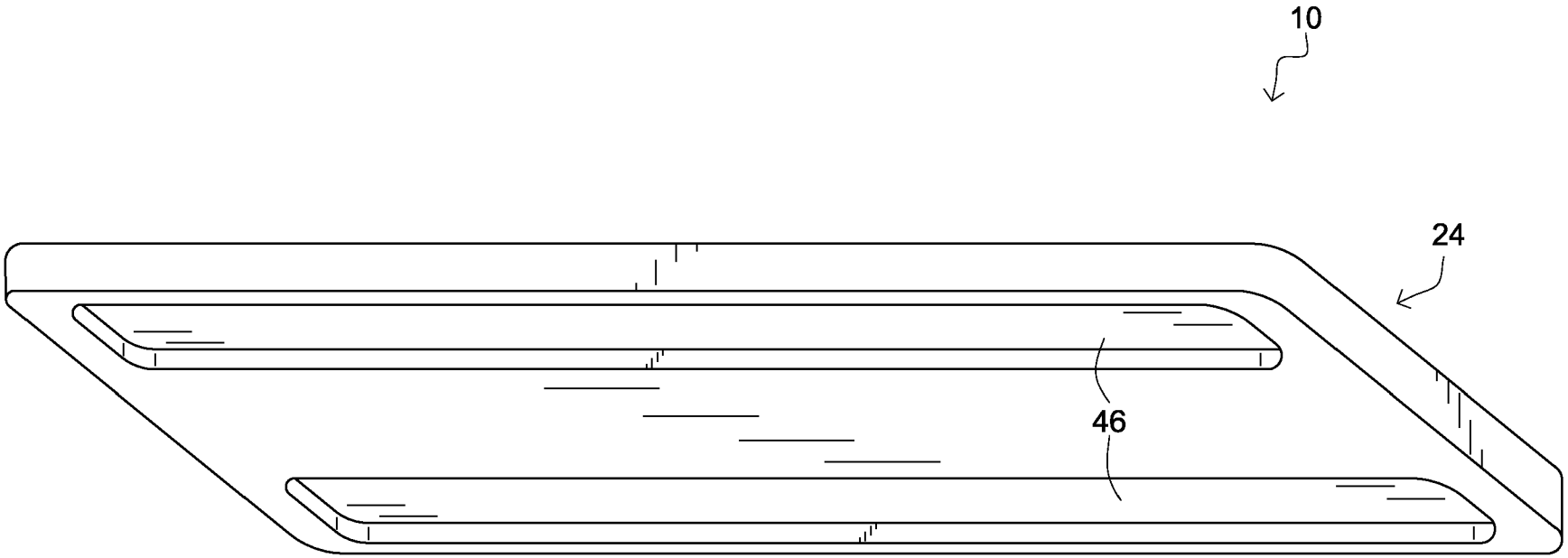
FIG. 6 is a bottom perspective view of an attachment member of an exercise device, according to one embodiment of the invention.

FIG. 6 is a bottom perspective view of an attachment member 24 of an exercise device 10, according to one embodiment of the invention. The exercise device 10 includes a selectably coupleable attachment member 24 coupled to a bottom surface of the pad member and configured to alter a movement characteristic of the exercise device 10 when in operation. As illustrated in FIG. 6, the attachment member 24 includes a vertically grooved surface 46 configured to alter a movement characteristic of the exercise device. The vertically grooved surface is configured to enable movement and a movement characteristic upon carpeted flooring.

In operation of one embodiment of the invention, a user performs upper body and abdominal exercises using an exercising device. The user selects an attachment member and couples the attachment member to a bottom portion of the exercise device thereby altering an operating characteristic of the device. The attachment member is a grooved surface. The grooved surface provides movement vertically, efficiently, however movement from side to side is somewhat impeded. The user then disposes both forearms on the top surface of a pad member of the device. The user grips a handle of the device and elevates the body creating pressure and supporting the body with the forearms on the pad member and the feet on the floor. The user then moves the exercise device about a floor in various directions. The user moves the exercise device horizontally, vertically, diagonally, in a circular motion, or a rectangular movement.

Figure 7:
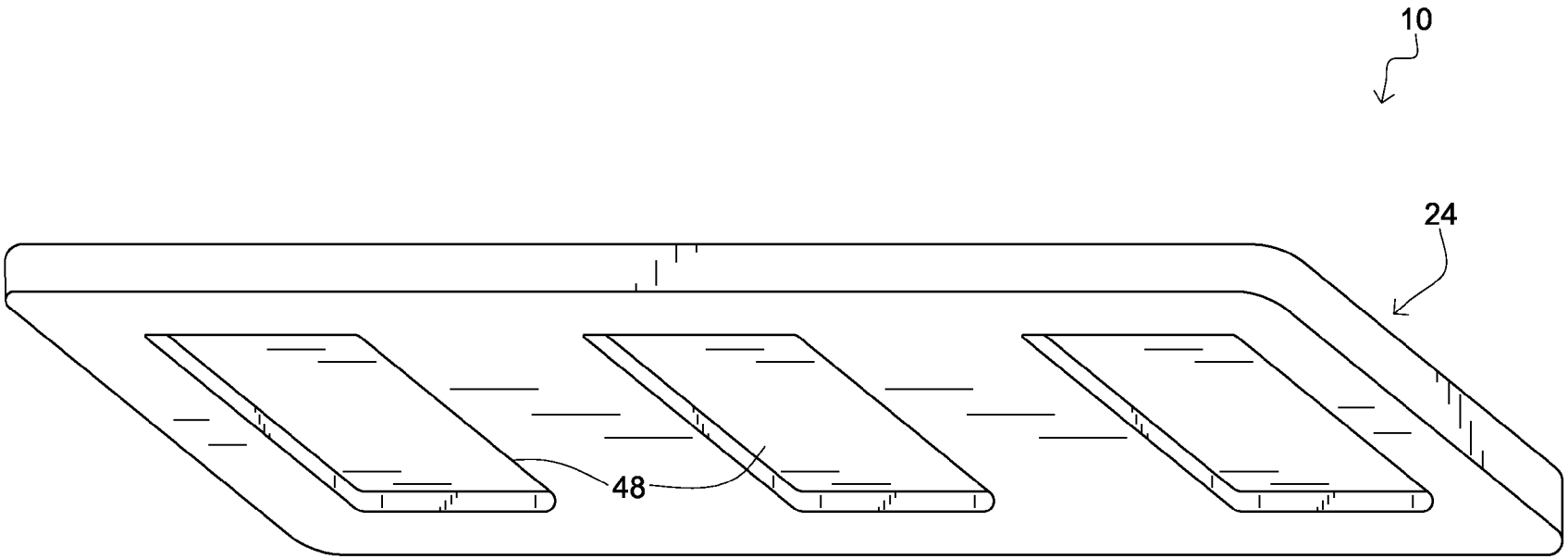
FIG. 7 is a bottom perspective view of an attachment member of an exercise device, according to one embodiment of the invention.

FIG. 7 is a bottom perspective view of an attachment member 24 of an exercise device 10, according to one embodiment of the invention. The exercise device 10 includes a selectably coupleable attachment member 24 coupled to a bottom surface of the pad member and configured to alter a movement characteristic of the exercise device 10 when in operation. As illustrated in FIG. 7, the attachment member 24 includes a horizontally grooved surface 48 configured to alter a movement characteristic of the exercise device. The horizontally grooved surface is configured to enable movement and a movement characteristic upon carpeted flooring.

In operation of one embodiment of the invention, a user performs upper body and abdominal exercises using an exercising device. The user selects an attachment member and couples the attachment member to a bottom portion of the exercise device thereby altering an operating characteristic of the device. The attachment member is a grooved surface. The grooved surface provides movement horizontally side to side, efficiently, however movement from up and down is somewhat impeded. The user then disposes both forearms on the top surface of a pad member of the device. The user grips a handle of the device and elevates the body creating pressure and supporting the body with the forearms on the pad member and the feet on the floor. The user then moves the exercise device about a floor in various directions. The user moves the exercise device horizontally, vertically, diagonally, in a circular motion, or a rectangular movement.

Figure 8:
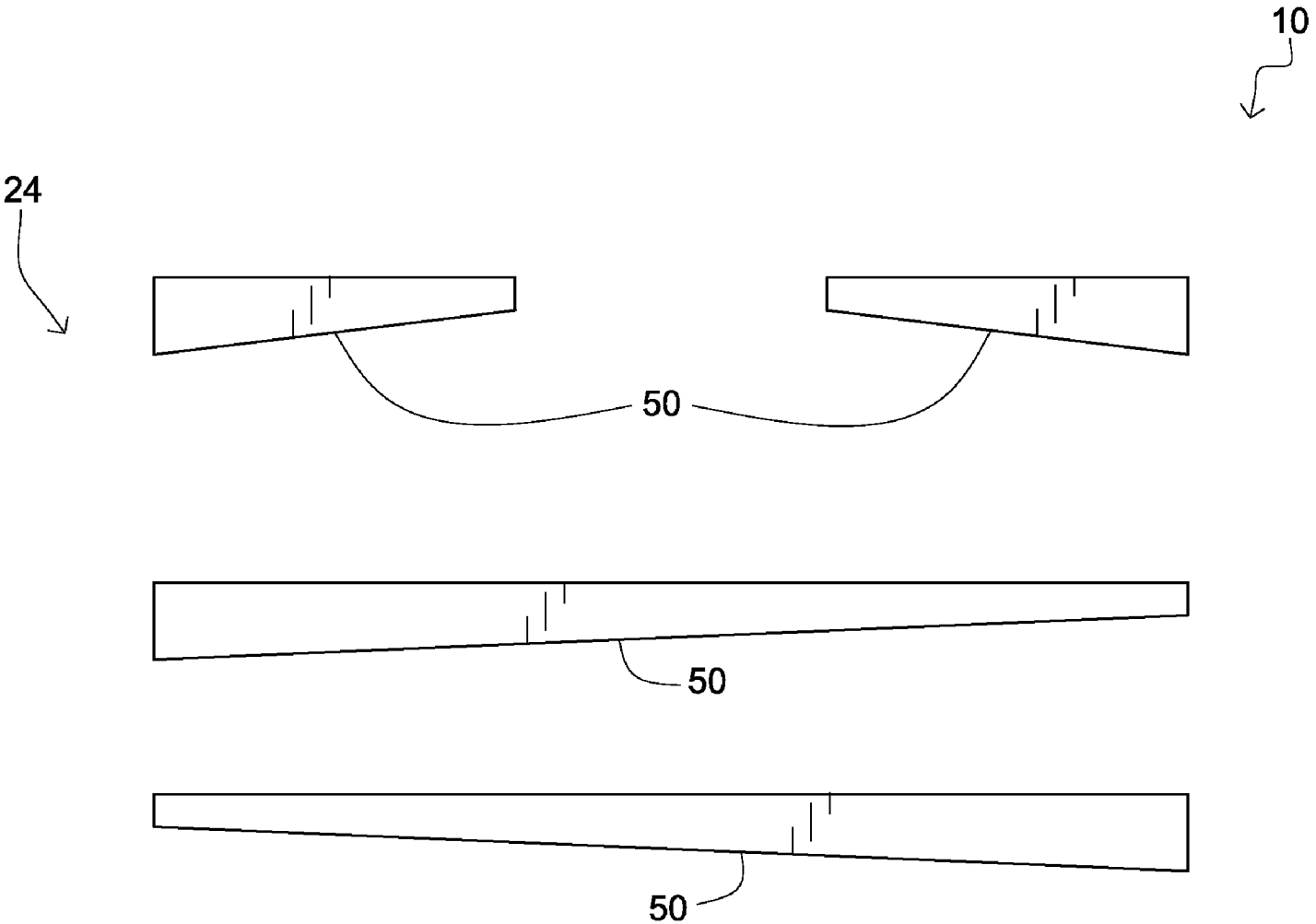
FIG. 8 is a set of side cross-sectional views of an attachment member of an exercise device, according to one embodiment of the invention.

FIG. 8 is a set of side cross-sectional views of an attachment member 24 of an exercise device 10, according to one embodiment of the invention. The exercise device 10 includes a selectably coupleable attachment member 24 coupled to a bottom surface of the pad member and configured to alter a movement characteristic of the exercise device 10 when in operation. As illustrated in FIG. 8, the attachment member 24 includes an inclined surface 50 configured to alter a movement characteristic of the exercise device. The inclined surface 50 is configured in various degrees and angles to provide resistance to movement of the exercise device.

In operation of one embodiment of the invention, a user performs upper body and abdominal exercises using an exercising device. The user selects an attachment member and couples the attachment member to a bottom portion of the exercise device thereby altering an operating characteristic of the device. The attachment member is a inclined surface. The inclined surface is configured to provide friction restriction in a particular direction. The inclined surface may be configured for up, down, left, or right friction restriction. The user then disposes both forearms on the top surface of a pad member of the device. The user grips a handle of the device and elevates the body, supporting the body with the forearms on the pad members and the feet on the floor. The user then moves the exercise device about a floor in various directions. The user moves the exercise device horizontally, vertically, diagonally movement. Moreover, the user may interchange the inclined surface to exercise various upper body muscle groups.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the Figures illustrates a grooved attachment member, an inclined attachment member, and a textile attachment member, one skilled in the art would appreciate that the attachment member may include materials such as but not limited to: rubber, felt, a rolling ball attachment, cotton, glass, plastic, plastic composite, rubber composite, metal, metal alloys, and still perform its intended function. In addition, one skilled in the art would appreciate that the attachment member may vary in vary bin size, shape, configuration, design, material, and still perform its intended function. In addition, one skilled in the art would appreciate that the selectably removable bottom surface attachment may include combinations of designs, specifically the attachments may include angled, grooved, or various materials in combination or in separate embodiments. Furthermore, one skilled in the art would appreciate that the grooves and/or angled attachments may vary in size, shape, length, width, depth, configuration, design, orientation, and still perform its intended function.

Additionally, although the figures illustrate an attachment member including plurality of wheels, one skilled in the art would appreciate that the wheels may vary in size, design, configuration, number, length, height, width, and still perform its intended function.

It is also envisioned that, one skilled in the art would appreciate that the pad member may vary in size, shape, design, material, configuration, color, elasticity, length, height, width, and still perform its intended function.

It is expected that there could be numerous variations of the design of this invention. An example is that the pad member may include an elbow support member, wherein the elbow support member is configured to support the elbow while performing the abdominal and upper body-type exercise.

Finally, it is envisioned that the components of the device may be constructed of a variety of materials, the handle, the selectably coupleable attachment member, pad member, may comprise material such as but not limited to: rubber, foam, composite foam, metal, metal alloys, plastic, rubber composite, textile, and still perform its intended function.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A method of performing upper body and abdominal exercises using an exercising device, having: a first and second identical section, where each section has a pad member with a horizontal to a floor length sufficient to support most of a forearm of a user, a grip extending vertically upward from the pad a sufficient distance to allow a user to grasp the grip by a respective hand of the user, a bottom portion coupled to the pad on an opposite side to the grip and designed to enable the first and second sections of the exercise device to slide on a horizontal floor, the method comprising the steps of:

a) placing the first and second identical sections of the exercise device, next to each other, on a flat horizontal surface;

b) orienting a torso of the user relatively parallel to the flat horizontal surface between the first and second identical sections;

c) orienting the left and right forearm of the user on top of the respective first and second pads of the identical sections of the exercise device so that the forearms are oriented substantially parallel to the torso of the user;

c) orienting the respective left and right hands of the user to grasp the respective first and second grips;

d) elevating the user off of the flat horizontal surface so that the complete user only has the left and right forearms and at least toes or knees of the user contacting the flat horizontal surface; and e) sliding the first and second identical sections of the exercise device in directions from a center line along the torso and head of the user, where the directions are selected from the group including: both outward, both inward, one outward, one inward, both parallel toward the head, both parallel away from the head, one parallel, both opposite, both same, one diagonal, both diagonal, one circular, and both in a circular direction.

2. The method of claim 1, wherein each identical section of the exercise device are placed on an incline plane before sliding the first and second identical sections.

3. The method of claim 1, wherein the identical sections of the exercise device are placed on a slotted surface that restricts motion of the identical sections from moving in a first direction and allows motion of the identical sections in a second direction.

4. A method of performing upper body and abdominal exercises, using an exercising device, the method comprising the steps of:

a) providing a first and second identical section, where each section includes: a pad member with a horizontal to a floor length sufficient to support most of a forearm of a user, a grip extending vertically upward from the pad a sufficient distance to allow a user to grasp the grip by a respective hand of the user, a bottom portion coupled to the pad on an opposite side to the grip and designed to enable the first and second sections of the exercise device to slide on a horizontal floor, b) placing the first and second identical sections of the exercise device, next to each other, on a flat horizontal surface;

c) orienting a torso of the user relatively parallel to the flat horizontal surface between the first and second identical sections;

d) orienting the left and right forearm of the user on top of the respective first and second pads of the identical sections of the exercise device so that the forearms are oriented substantially parallel to the torso of the user;

e) orienting the respective left and right hands of the user to grasp the respective first and second grips;

f) elevating the user off of the flat horizontal surface so that the complete user only has the left and right forearms and at least toes or knees of the user contacting the flat horizontal surface; and g) sliding the first and second identical sections of the exercise device in directions from a center line along the torso and head of the user, where the directions are selected from the group including: both outward, both inward, one outward, one inward, both parallel toward the head, both parallel away from the head, one parallel, both opposite, both same, one diagonal, both diagonal, one circular, and both in a circular direction.

5. The method of claim 4, wherein each identical section of the exercise device are placed on an incline plane before sliding the first and second identical sections.

6. The method of claim 4, wherein the identical sections of the exercise device are placed on a slotted surface that restricts motion of the identical sections from moving in a first direction and allows motion of the identical sections in a second direction.

* * * * *